US006511455B1

(12) United States Patent
Tuoriniemi

(10) Patent No.: US 6,511,455 B1
(45) Date of Patent: Jan. 28, 2003

(54) MEDICINE DISPENSER DEVICE FOR CHILDREN

(76) Inventor: Veijo Matias Tuoriniemi, 210 E. 17th St., Apt. 4D, New York, NY (US) 10003-3629

( * ) Notice: Subject to any disclaimer, the term of this patent is extended or adjusted under 35 U.S.C. 154(b) by 0 days.

(21) Appl. No.: 09/699,935

(22) Filed: Oct. 30, 2000

Related U.S. Application Data

(60) Provisional application No. 60/162,478, filed on Oct. 29, 1999.

(51) Int. Cl.[7] ..... A61J 7/00
(52) U.S. Cl. ..... 604/77
(58) Field of Search ..... 604/77, 191, 78, 604/218, 207, 213, 514–517, 27, 30, 36, 39, 43; 606/234, 236

(56) References Cited

U.S. PATENT DOCUMENTS 5,244,122 A * 9/1993 Botts ..... 604/77
5,843,030 A * 12/1998 Van Der Merwe ..... 604/77
5,843,042 A * 12/1998 Ren ..... 604/207
5,891,165 A * 4/1999 Buckner ..... 606/234

* cited by examiner

*Primary Examiner*—Sharon Kennedy

(57) ABSTRACT

A medicine dispenser having a first medicine chamber where the liquid medicine is measured before dispensing it to a mouth of a patient by a pressure. Medicine dispenser has a nozzle in the distal end of said medicine dispenser, allowing liquid medicine in flow to the patient's mouth by said first pressure. Additionally the Medicine dispenser has a second conduit leading from said nozzle end of said medicine dispenser to a second expansion chamber. From the expansion chamber, the medicine can be re-introduced to the patient.

6 Claims, 3 Drawing Sheets

MEDICINE DISPENSER DEVICE FOR CHILDREN

This application claims benefit of Provisional No. 60/162,478 filed Oct. 29, 1999.

FIELD OF INVENTION

This invention relates to oral dispensing devices which are used to administrate liquids, e.g. medicine for a resistive patient e.g. children. More particulary this device relates to a syringe having an additional passage in a nozzle leading to an expansion chamber where rejected medicine from patient's mouth is temporarily evacuated before re-occupation back to the patients oral cavity.

BACKROUND OF THE INVENTION

U.S. Pat. No. 4,127,126 for George J. Schunk discloses an additional elongated nozzle for a syringe. The nozzle is an elongated tube lengthening the tip of the syringe enabling administration of medicine deep in patient's mouth. Additionally the device has a lip abutment skirt preventing mouth contamination with the barrel.

None of prior art devices has a solution for a situation when resistive patient, especially a child tries to resist the administration of a liquid medicine by expelling it out of his/her mouth. By using prior art devices the expelled medicine is lost on a cheek of a child and dispensing of right amount of medicine can be questionable, since lost medicine amount cannot be measured resulting possible incorrect dosage of the medicine.

DRAWING FIGURES

DESCRIPTION PREFERRED EMBODIMENT

Figure 1:
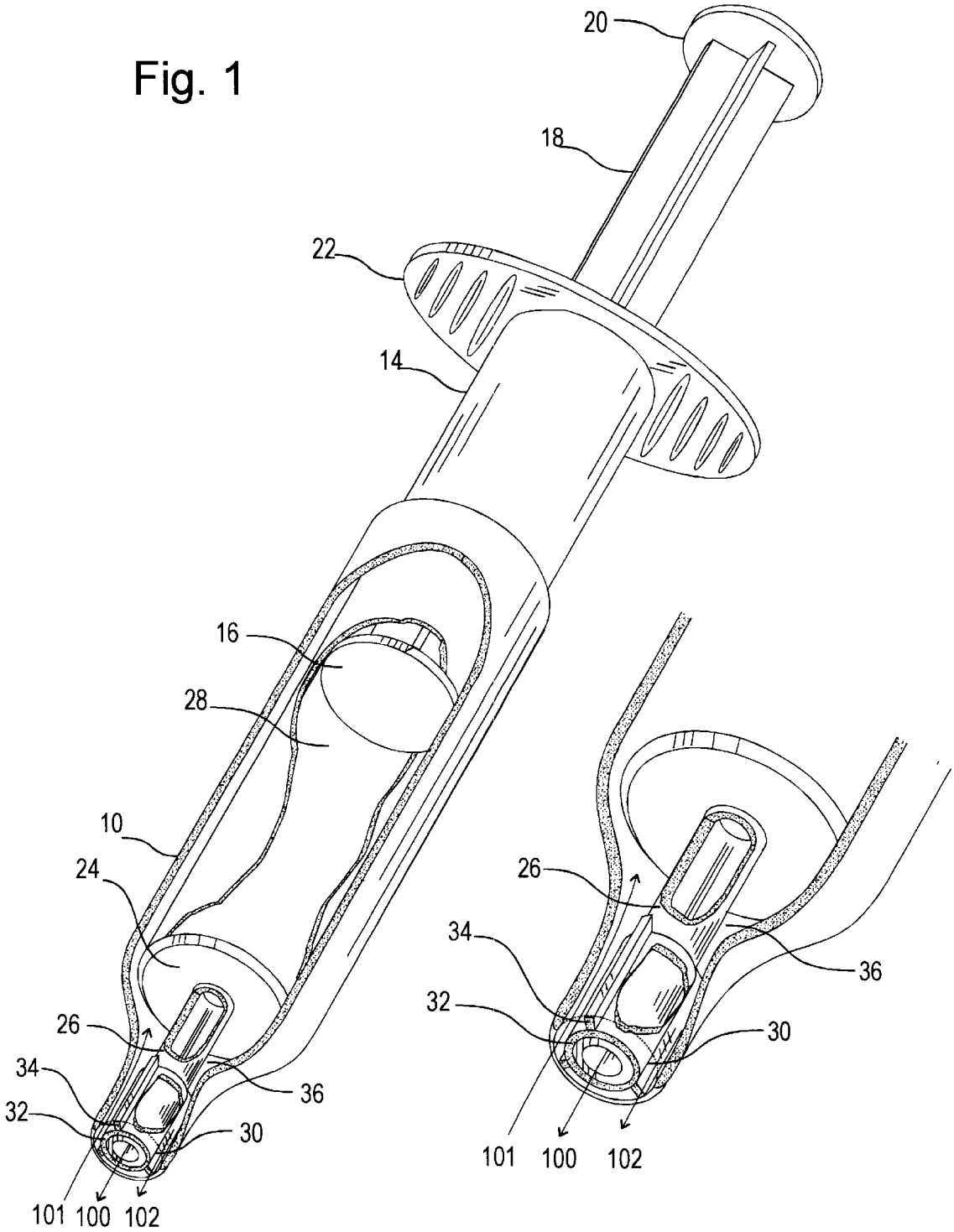
FIG. 1 shows a perspective cross sectional view of preferred embodiment with an expansion over a syringe.

FIG. 1 shows a removable nozzle 10 placed over a syringe 12. Syringe 12 has a hollow, elongated, barrel body 14 having a piston 16 with a plunger 18 and a thumb rest 20 slidably inserted inside of the barrel body 14 through the upper end of the body 14. The upper end of the body 14 also has finger grips 22 to support fore- and middle finger when pressure is applied.

Lower part of the body 14 ends to a wall 24. The wall 24 tapers at relatively sharp angle and joins an elongated hollow tip 26. The outer surface of the tip 26 tapers at slighter angle progressing away from the wall 24. The barrel body 14, piston 15 and the wall 24 determine [define?] a first chamber 28 where the medicine can be drawn.

The nozzle opening 30 has an elongated, hollow body connector 32 in the middle of the opening. The inner surface of connector 32 tapers at the same angle then the tip 26 and mates over it. The connector 32 is connected to the nozzle body 10 with bridges 34. The nozzle 10 has a relatively small diameter over the tip 26, but the diameter extends to cover the syringe barrel 14. The outer surface of the barrel and inner surface of the nozzle defines a second, expansion chamber 36.

Instead of having a removable nozzle, the nozzle can be made stationary connected to the syringe.

Operation of the First Embodiment

The medicine is drawn to the syringe 12 through the hollow tip 26. The nozzle 10 placed over the tip 26 and the barrel body 14 of the syringe 12. The opening 30 of the nozzle 10 with the tip 26 in the middle of the opening is placed to patient's mouth. The medicine is administrated to the oral cavity through the tip 26 by pressing the thumb rest 20 of the piston 16 (flow 100). When patient resists administration of the medicine by expelling the medicine out of his/her mouth, the medicine is conducted to the expansion chamber 36 through the nozzle opening 30 (flow 101). When patient de-pressurizes his/her mouth, the medicine in the expansion chamber 36 flows back to patient's mouth (flow 102).

Description of the Second Embodiment

Figure 2:
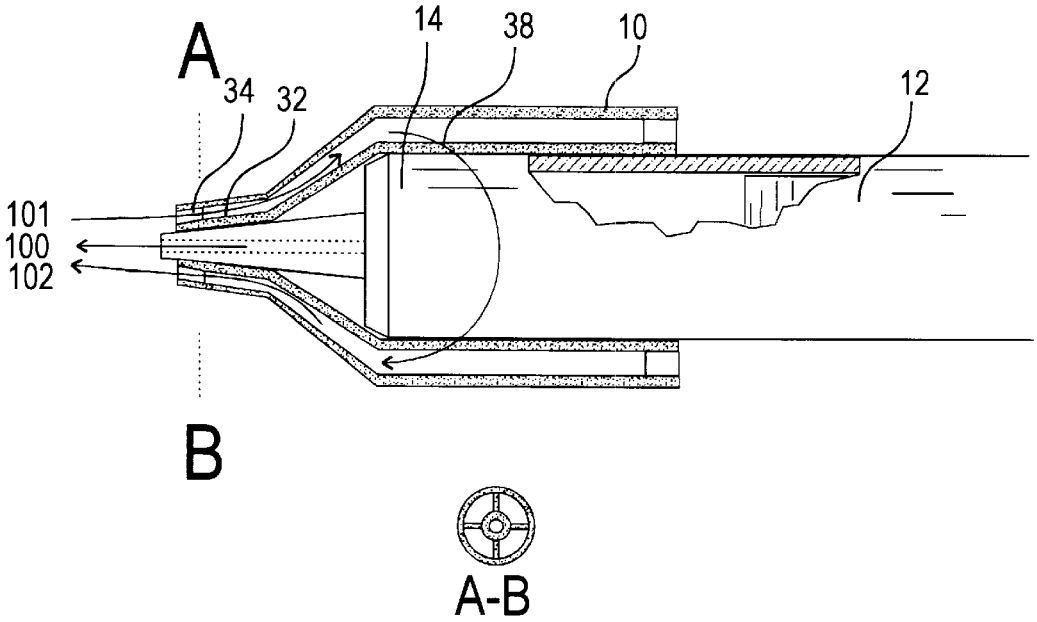
FIG. 2 shows a cross sectional side view of a second embodiment with a two-wall expansion chamber.

FIG. 2 shows an embodiment having an extended connector 32 part forming an inner wall 38 between the syringe 12 and the nozzle 10. The expelled medicine from patients mouth is temporarily stored to the expansion chamber 36 determined by the inner wall 38 and the nozzle 10. Inner wall prevents the contamination of the medicine with the barrel body 14 of the syringe 12.

CONCLUSION, RAMIFICATIONS AND SCOPE

Figure 3:
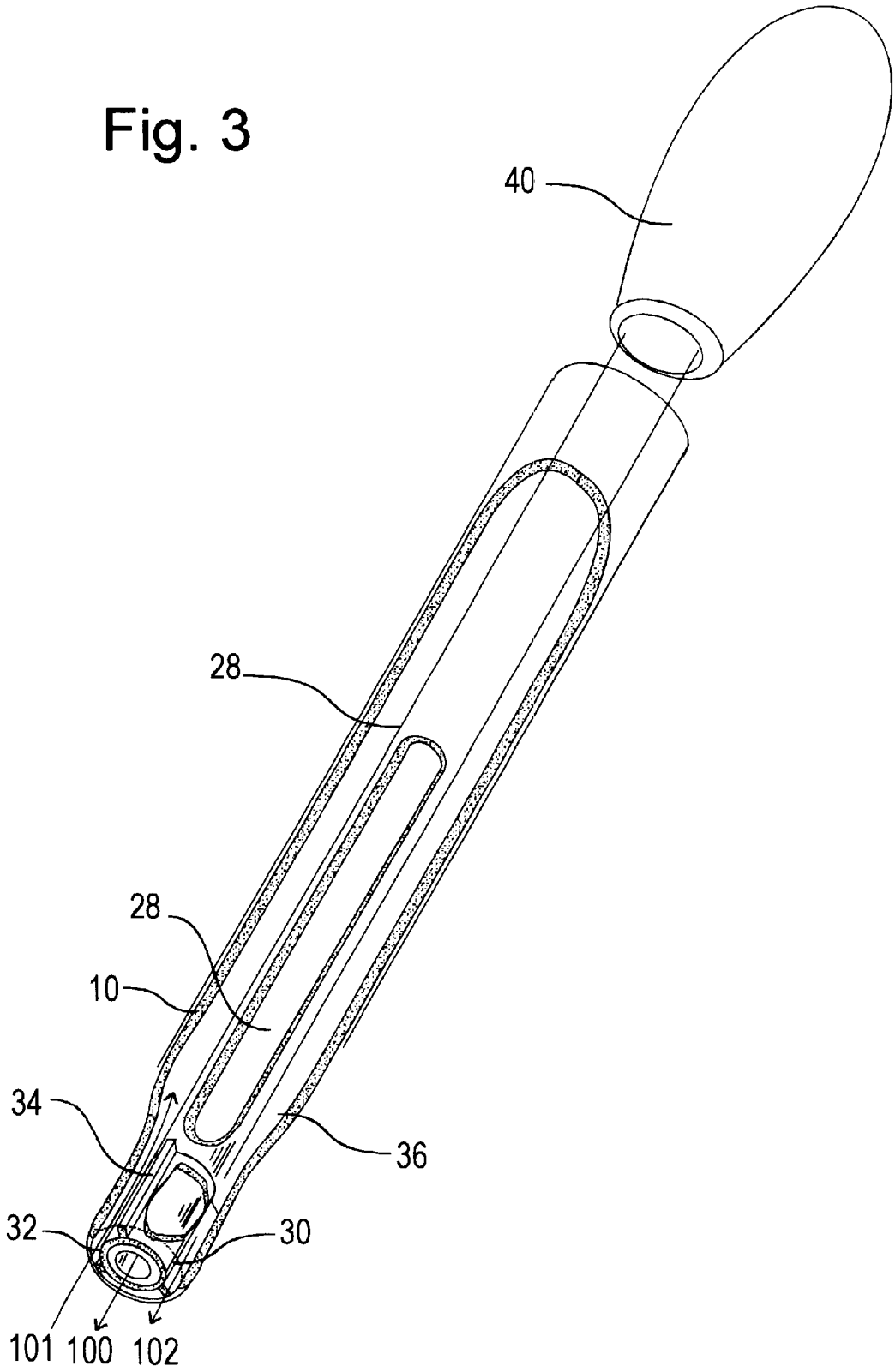
FIG. 3 shows a cross sectional side view of an expansion chamber mounted over a medicine dropper.

FIG. 3 shows an expansion chamber mounted over a medicine dropper. The device works a similar way than the previously described embodiment, except the medicine is drawn into the medicine chamber by a bulb 40 and expelled by pressing it. Is understood that the expansion chamber can be stationary or removable. If removable it can have one wall or two walls as the embodiment in FIG. 2.

While the invention has been described with respect to specific embodiments by way of illustration, many modifications and changes will occur to those skilled in the art. It is, therefore, to be understood that the append claims are intended to cover all such modifications and changes as fall within the true scope and spirit of the invention.

LIST OF REFERENCE NUMERALS

10 nozzle
12 syringe
14 elongated hollow body of the syringe
16 piston
18 plunger
20 thumb rest
22 finger grip
24 wall
26 tip
28 first, medicine chamber
30 opening of the nozzle
32 connector
34 bridge
36 expansion chamber
38 inner wall
40 bulb
100 liquid flow from the syringe to the mouth
101 liquid flow from the mouth to the expansion chamber
102 liquid flow from the expansion chamber to the mouth

I claim:

1. A medicine dispenser having a) a first medicine chamber where the liquid medicine is measured before dispensing it to a mouth of a patient by a first pressure and;

b) a first conduit leading from said first medicine chamber to an opening of a nozzle in the distal end of said medicine dispenser, allowing liquid medicine in flow to a first direction by said first pressure and;

c) A second conduit leading from said distal end of said medicine dispenser to a second expansion chamber;

said second conduit allowing liquid medicine to flow to a second direction by a second opposing pressure generated by a patient, leading said liquid medicine to said second expansion chamber, where said medicine is stored after being expelled from a resistive patient's mouth by said second opposing pressure and wherefrom said medicine can be reintroduced to the patient.

2. A medicine dispenser of claim 1 wherein said first pressure is formed by a piston.

3. A medicine dispenser of claim 1 wherein said first pressure is formed by a bulb.

4. A medicine dispenser of claim 1 wherein said second expansion chamber is removable.

5. A medicine dispenser of claim 1 wherein said second expansion chamber is integrally formed with said first medicine chamber.

6. A medicine dispenser of claim 1 wherein said second expansion chamber has an outer wall and an inner wall preventing said expelled medicine from touching the outer wall of said medicine chamber.

* * * * *